United States Patent [19]

Wada et al.

[11] 4,138,264

[45] Feb. 6, 1979

[54] SILVER HALIDE EMULSION CONTAINING TWO EQUIVALENT TYPE COUPLER FOR USE IN PHOTOGRAPHY

[75] Inventors: Hajime Wada; Kazuhiko Kimura; Haruo Hori; Shoji Kikuchi; Takaya Endo, all of Hino, Japan

[73] Assignee: Konishiroku Photo Industry Co., Ltd., Tokyo, Japan

[21] Appl. No.: 872,387

[22] Filed: Jan. 26, 1978

Related U.S. Application Data

[63] Continuation of Ser. No. 656,346, Feb. 9, 1976, abandoned, which is a continuation of Ser. No. 472,477, May 22, 1974, abandoned.

[30] Foreign Application Priority Data

May 23, 1973 [JP] Japan ..... 48-57829

[51] Int. Cl.$^2$ ..... G03C 1/40

[52] U.S. Cl. ..... 96/100 R; 96/9; 96/55; 96/77

[58] Field of Search ..... 96/100 R, 55, 74

[56] References Cited

U.S. PATENT DOCUMENTS

| | | | |
|---|---|---|---|
| 3,432,521 | 3/1969 | Loria | 96/100 |
| 3,447,928 | 6/1969 | Loria | 96/100 |

*Primary Examiner*—J. Travis Brown

*Attorney, Agent, or Firm*—Bierman & Bierman

[57] ABSTRACT

A novel two-equivalent naphthol or phenol type cyan coupler is disclosed wherein the active position thereof has a split-off group which contains a bonding group of the formula $$-\mathrm{OCON}\underset{\mathrm{R}}{-}$$

wherein R is hydrogen atom or a divalent organic group. The present coupler is incorporated into a photographic material containing a photosensitive emulsion layer.

4 Claims, No Drawings

SILVER HALIDE EMULSION CONTAINING TWO EQUIVALENT TYPE COUPLER FOR USE IN PHOTOGRAPHY

This application is a Rule 60 Continuation of Ser. No. 656,346 filed Feb. 9, 1976, now abandoned, which in turn is a Rule 60 Continuation of parent application Ser. No. 472,477 filed on May 22nd, 1974, now abandoned, and claims the priority of Japanese application No. 57829/1973 filed May 23rd, 1973.

This invention relates to a novel coupler for use in photography. More particularly, the invention relates to a novel coupler for use in photographic processes using a silver halide as a photosensitive component.

In the art of photography, silver halides are frequently used for recording of light informations because they are excellent in photographic characteristics such as sensitivity and gradation. In case such silver halide is used as a photosensitive component, in order to obtain a colored image the silver halide is generally combined with a certain kind of a color-forming compound and this color-forming compound is reacted with a certain kind of a reactive compound to form a dye in correspondence with the information recorded on the silver halide, namely a dye image. This color-forming compound is generally called a coupler, and the reactive compound is a color-forming developing agent such as an aromatic primary amine developing agent.

As is well known in the art, when light is recorded imagewise on a silver halide having the center of development and the silver halide is developed in the presence of a coupler with a developing agent, the developing agent reduces the silver halide to reduced silver, and the developing agent per se is oxidized to form an active oxidation product of the developing agent and this oxidation product reacts with the coupler to form a dye, with the result that a dye inage corresponding with the informaton recorded on the silver halide is formed.

The reaction between the coupler and developing agent is performed on the active position of the coupler, and the active position redides generally at an active methine or methylene group in the molecule of the coupler.

A coupler having a hydrogen atom at this active position is called a 4-equivalent coupler, and a coupler having at this active position a group capable of being readily split at the reaction between the coupler and developing agent, namely a so called split-off group, is called a 2-equivalent coupler.

In the case of a 4-equivalent coupler, at the reaction of the coupler with the developing agent, 4-equivalents of a silver halide having the center of development are required per active position, but in the case of a 2-equivalent coupler only 2-equivalents of a silver halide are required. Therefore, the 2-equivalent coupler provides a dye image of a higher concentration than the 4-equivalent coupler, when compared based on the same amount of developed silver. Further, in the case of the 2-equivalent coupler, if a group bonding the split-off group (bonding group) is chosen appropriately, it is possible to impart a development-inhibiting activity to a compound formed by splitting of the split-off group. For example, a 2-equivalent coupler having a split-off group with a thio group (-s-) as the bonding group is called a development inhibitor-releasing coupler (D. I. R. coupler) and since this coupler inhibits the development in proportion to the amount of developed silver, it can be applied in various manners. For example, This D. I. R. coupler exhibits so called intra-image effects in its own layer, such as effects of controlling the image tone and finely dividing the image particles, and so-called inter-image effects on other layers, such as effects of improving the dye hue. Further, the coupler of this type has various function on other layers. By virtue of these effects and functions, the coupler of this type is also utilized to the diffusion transfer type photography.

Still in addition. Some 2-equivalent type couplers, for instance, those in which a dye component is included in the split-off group can be used in the diffusion transfer type photography and in this case, the split dye is utilized for formation of an image of a diffused dye on an image-receiving layer. A coupler of this type is called a diffusable dye-releasing coupler (D. D. R. coupler). Further, some colored 2-equivalent couplers have a masking effect of correcting the color of the dye image, and a coupler of this type is called a colored coupler.

Because of the foregoing substantial advantages over 4-equivalent couplers and various applicabilities, 2-equivalent couplers tend to be used more frequently than 4-equivalent couplers.

Although heretofore known 2-equvalent couplers are excellent over 4-equivalent couplers in various characteristics, they are still insufficient in the dye-forming rate and they are likely to cause fogs or contaminations on a slver halide-containing photosensitive layer. They are also defective in that they cannot be dispersed in a photosensitive layer at a sufficient dispersion concentration. Improvement of these defects of 2-equivalent type couplers has been demanded in the art.

It is a primary object of this invention to provide a novel 2-equivalent type coupler in which the foregoing defects involved in conventional 2-equivalent type couplers are overcome.

Another object of this invention is to provide a 2-equivalent type coupler having excellent photographic characteristics.

Still another object of this invention is to provide a silver halide photosensitive material including such 2-equivalent type coupler and a photographic process using such 2-equivalent type coupler.

In accordance with this invention, there is provided a two-equivalent type coupler for use in photography characterized in that it has on the active position a split-off group including as a bonding group a group represented by the following general formula [1]

$$-\mathrm{OCON}\underset{\underset{\mathrm{R}}{|}}{-} \qquad [1]$$

wherein R stands for a hydrogen atom or a divalent organic group, and the carbonyloxy portion of the split-off group is positioned on the active position side.

The above 2-equivalent type coupler of this invention has a so called urethane linkage, and by virtue of the presence of this urethane linkage, it can possess various preferred properties. For instance, it has a high dye-forming rate and causes no fogs or contaminations in a photosensitive layer, and it has such a high dispersibility that it can be dispersed at a high concentration into photographic material-constituting layers such as a photosensitive layer. Further, a dye formed from this coupler is highly resistant to light, heat and temperature change, and it has such excellent light absorption characteristics that it has no absorption to undesired rays but exhibits a sharp absorption to required rays. Furthermore, the coupler of this invention is free of the development-inhibiting property inherent of some kinds of 2-equivalent couplers.

In case the 2-equivalent type coupler of this invention is incorporated in a silver halide photosensitive material, the thickness of a photosensitive layer can be much reduced, and the resolving power of the dye image and the sharpness of the dye image can be highly improved. Especially in the case of a multi-layer photosensitive material, the permeability of light to lower layers is improved by the use of the coupler of this invention, and therefore, the photographic sensitivity can be highly improved. These are some of advantages attained by the coupler of this invention.

Typical instances of the 2-equivalent type coupler of this invention can be represented by the following formulae [11] and [111]:

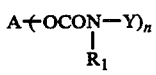

[11]

and

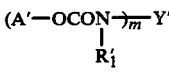

[111]

wherein A and A' stand for a cyane coupler residue, $R_1$ and $R_1'$ have the same meaning as R, Y is a monovalent organic group, Y' is an organic group having a valency of *m*, and *n* and *n* stand for a positive integer.

The forgoing formulae [11] and [111] stand for principal 2-equivalent couplers to be used in this invention, and also 2-equivalent couplers composed of a mixture of couplers of types [11] and [111] can be used in this invention. Residues in the above general formulae [11] and [111] correspond to those left after removal of a hydrogen atom or split-off group at the active position from cyane couplers. In the case of the coupler having a plurality of active position, split-off groups to be introduced at the active position may be the same or different, and further, such coupler may contain a hydrogen atom at one or more of the active position. It is, however, preferred that all of the active position are occupied by split-off groups specified in this invention.

In the above general formulae [11] and [111], preferred examples of the group Y include aliphatic hydrocarbon residues, aromatic hydrocarbon residues, hetero-ring residues, acyl groups, thioacyl groups and groups $—SO_2—R_2$ in which $R_2$ is an aliphatic hydrocarbon residue or the like, and these groups may comprise a substituent. Preferred examples of the group Y' include aliphatic hydrocarbon residues of a valency of *m*, aromatic hydrocarbon residues of a valency of *m*, and hetero-ring residues of a valency of *m*, and these groups may comprise a substituent. Groups of a valency of *m* composed of these groups bonded to one another can be mentioned as the group Y'. For instance, composite divalent groups composed of divalent aliphatic hydrocarbon residues and arylene groups bonded to one another, namely those in which *k* of divalent aliphatic hydrocarbon residues (*k* is a positive number) and *l* of arylene groups (*l* is a positive number) are bonded to one another in the blocked or randam manner, can be used as the group Y'. These groups of a valency of *m* may have such groups as carbonyl, thiocarbonyl and sulfonyl groups at the terminal end thereof. Further, in these *m*-valent groups, the two adjacent carbon atoms may be divided by an oxygen atom, a sulfur atom, an amino group, a carbonyloxy group, an aminocarbonyl group, a sulfoneamide group or the like. Preferred examples of R, $R_1$ and $R_1'$ groups are a hydrogen atom, acyl groups, aliphatic hydrocarbon groups and the like. It is preferred that *n* and *m* stand for 1 or 2, but in the case of a cyane coupler known as a polymer coupler, *n* and *m* can be 3 or more than 3.

Cyane coupler redidues of typical preferred examples of the cyane coupler to be used in this invention are represented by the following general formulae [IV], [V] and [VI]:

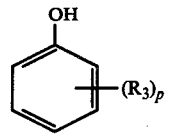

[IV]

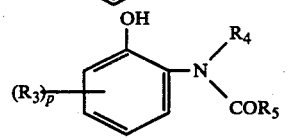

[V]

and

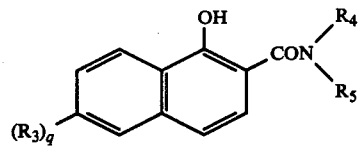

[VI]

wherein $R_3$ stands for a hydrogen or halogen atom, an aliphatic hydrocarbon residue or a group $—O—R_6$ or $—S—R_6$ in which $R_6$ is an aliphatic hydrocarbon residue, and when a plurality of groups $R_3$ are present in one molecule, they may be the same or different and further the hydrocarbon residue may have a substituent; $R_4$ and $R_5$ stand for a member selected from aliphatic hydrocarbon residues, aryl groups and hetero-ring residues or one of them may be a hydrogen atom, these groups may have a substituent, and $R_4$ and $R_5$ may form together a nitrogen-containing hetero-ring; and *p* is an integer of 1 to 4 (in the formula [V] *p* is an integer of 1 to 3), and *p* is an integer of 1 to 5.

In the foregoing formulae, the aliphatic hydrocarbon residue may be either saturated or unsaturated, and it may be straight, branched or cyclic. Preferred examples of the aliphatic hydrocarbon residue include alkyl groups such as methyl, ethyl, isobutyl, dodecyl, octadecyl, cyclobutyl and cyclohexyl groups, and alkenyl groups such as an allyl group. Typical examples of the aryl group are phenyl and naphthyl groups, and typical examples of the hetero-ring residue are pyridyl, quinolyl, thienyl, piperidyl and imidazolyl groups. As the substituent to be introduced into such aliphatic, aryl or hetero-ring residue, there can be mentioned halogen atoms, a nitro group, a hydroxyl group, a carboxyl group, an amino group, a substituted amino group, a sulfo group, and substituted and unsubstituted alkyl, alkenyl, aryl, hetero-ring, alkoxy, aryloxy, arylthio, arylazo, acylamino, carbamoyl, ester, acyl, acyloxy, sulfoneamide, sulfamoyl, sulfonyl, morpholino, piperazyl and imidazolyl groups. As the hetero-ring formed by $R_4$ and $R_5$, there can be preferaby used the above-exemplified nitrogen-containing hetero-rings.

In the foregoing general formulae [11] and [111], the aliphatic hydrocarbon residue may be saturated or unsaturated, and it may be straight, branched or cyclic. As typical instances of the mono-valent aliphatic hydrocarbon residue, there can be mentioned alkyl and alkenyl groups, and there are preferably employed methyl, ethyl, isobutyl, octyl, t-octyl, octadecyl, cyclobutyl, cyclohexyl and 2-norbonyl groups. Alkylene groups are typical instances of the divalent aliphatic hydrocarbon residue, and there are preferably employed methylene, ethylene, butylene and hexylene groups. Typicl instances of the aromatic hydrocarbon residue are aryl and arylene groups, and phenyl, naphthyl, phenylene and naphthylene groups are preferred. Preferred examples of the hetero-atom ring residue are residues of 5- and 6-membered hetero-rings containing such a hetero atom as nitrogen, sulfur and oxygen such as monovalent groups, e.g., thienyl, pyridyl, quinolyl and oxadiazolyl groups, and divalent groups, e.g., pyridinylene and quinolylene groups. Acetyl, benzoyl and naphthoyl groups are preferred as the thioacyl group. As the sulfonyl group, there can be mentioned, for example, phenylsulfonyl, chlorosulfonyl and methanesulfonyl groups.

Various groups used as Y, $R_1$, Y' and $R_1'$ in the general formulae [11] and [111] and R in the general formula [1] may have a substituent, as mentioned above. Typical instances of such substituent are those exemplified hereinabove as regards substituents to be introduced into the above general formulae IV, V and VI.

Typical instances of the split-off group of the general formula [1] having a divalent group as a bonding group with the carbonyloxy portion being positioned on the active point side are as follows:

| | |
|---|---|
| Methylaminocarbonyloxy group | $-OCONHCH_3$ |
| Ethylaminocarbonyloxy group | $-OCONHC_2H_5$ |
| Butylaminocarbonyloxy group | $-OCONHC_4H_9$ (iso, tert, sec) |
| Propylaminocarbonyloxy group | $-OCONHC_3H_7$ (iso) |
| Dodecylaminocarbonyloxy group | $-OCONHC_{12}H_{25}$ |
| Octadecyaminocarbonyloxy group | $-OCONHC_{18}H_{37}$ |
| 2,5-di-tert-aminophenoxymethylaminocarbonyloxy group | 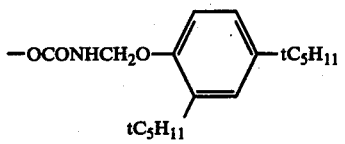 |
| Phenetylaminocarbonyloxy group | 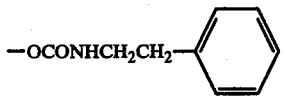 |
| Benzylaminocarbonyloxy group | 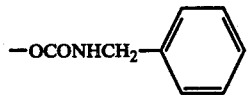 |
| Anilinocarbonyloxy group | 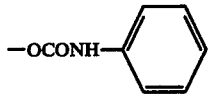 |
| α-Naphthylaminocarbonyloxy group | 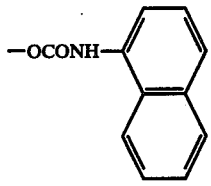 |
| β-Naphthylaminocarbonyloxy group | 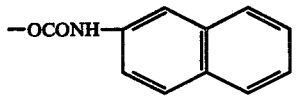 |
| 4-Nitroanilinocarbonyloxy group | 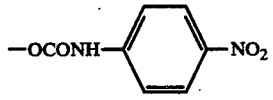 |
| 4-Chloroanilinocarbonyloxy group | 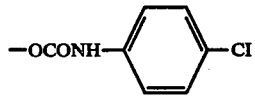 |
| 4-Methylanilinocarbonyloxy group | 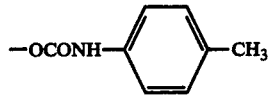 |
| 2,4-Dimethylanilinocarbonyloxy group | 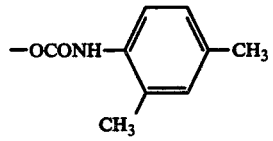 |

-continued

4-Aminoanilinocarbonyloxy group

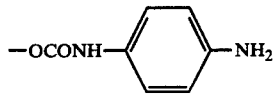

4-(2-Hydroxy-5-sodium-sulfophenylazo)-anilino-carbonyloxy group

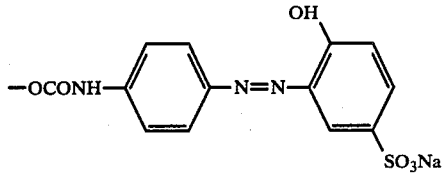

Ethylene-bis-aminocarbonyloxy group $—OCONH—CH_2CH_2—NHCOO—$

Hexamethylene-bis-aminocarbonyloxy group $—OCONH—(CH_2CH_2)_3—NHCOO—$ 4,4'-Methylene-bis-anilinocarbonyloxy group

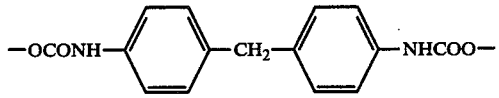

1,4-Phenylene-bis-aminocarbonyloxy group

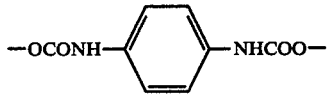

1,3-Phenylene-bis-aminocarbonyloxy group

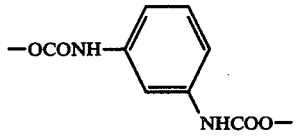

1,5-Naphthalene-bis-aminocarbonyloxy group

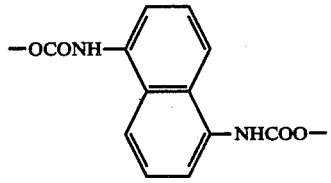

4,4'-Diphenylene-bis-aminocarbonyloxy group

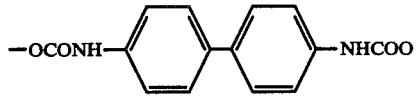

2,4-Tolylene-bis-aminocarbonyloxy group

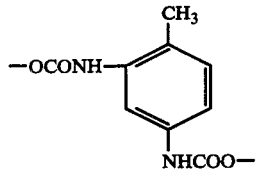

6-Methyoxy-4-qunolylaminocarbonyloxy group

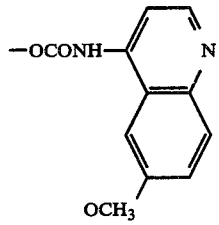

Benzoylaminocarbonyloxy group

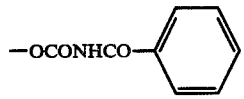

Chloroacetylaminocarbonyloxy group $—OCONHCOOCH_2Cl$

N-phenyl-N-acetylaminocarbonyloxy group

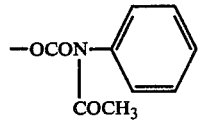

Phenylsulfonylaminocarbonyloxy group

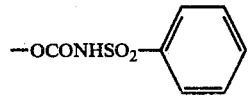

-continued

| | |
|---|---|
| Thiobenzoylaminocarbonyloxy group | 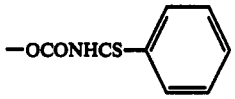 |
| 2,4-Tolylene-bis-sulfonylaminocarbonyloxy group | 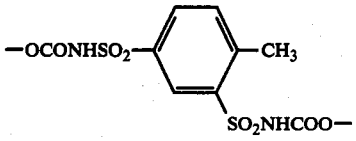 |
| p-Phenylene-bis-carbonylaminocarbonyloxy group | 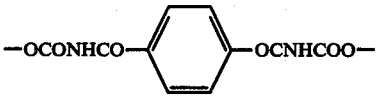 |
| p-Phenylene-bis-thiocarbonylaminocarbonyloxy group | 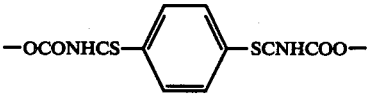 |

Cyane couplers represented by the general formulae [IV], [V] and [VI] and having such a split-off group as mentioned above at the active position are preferably used in this invention, and it is believed that excellent photographic characteristics of the coupler of this invention such as mentioned above are owing to the bonding group in the specific split-off group.

Typical instances of the coupler of this invention will now be mentioned, but couplers that can be used in this invention are not limited to these instances.

(1) I-Hydroxy-4-anilinocarbonyloxy-N-[δ-(2,4-di-tert-amylphenoxy)butyl]-2-naphthoamide

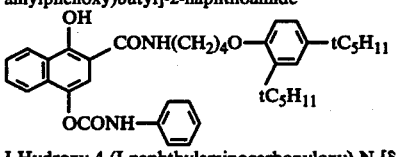

(2) I-Hydroxy-4-(I-naphthylaminocarbonyloxy)-N-[δ-(2,4-di-tert-amylphenoxy)butyl]-2-naphthoamide

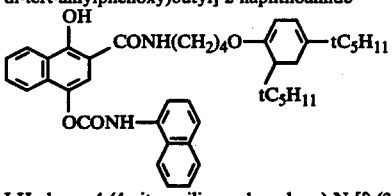

(3) I-Hydroxy-4-(4-nitroanilinocarbonyloxy)-N-[δ-(2,4-di-tert-amylphenoxy)butyl]-2-naphthoamide

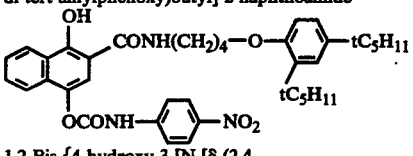

(4) 1,2-Bis-{4-hydroxy-3-[N-[δ-(2,4-di-tert-amylphenoxy)butyl] carbamoyl -I-naphthyloxy-carbamino ethane

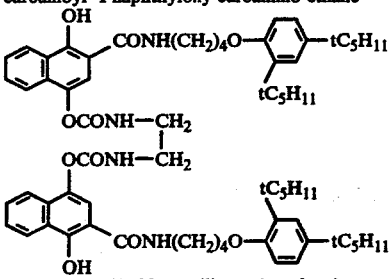

(5) I-Hydroxy-4-(4-chloroanilinocarbonyloxy)-n-dodecyl-2-naphthoamide

-continued

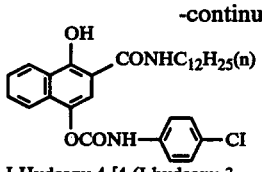

(6) I-Hydroxy-4-[4-(I-hydroxy-3,6-disulfonaphthylazo)anilinocarbonyloxy]-n-dodecyl-2-naphthoamide (2) sodium salt

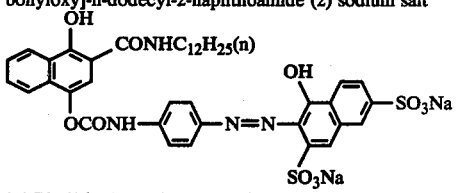

(7) 2,4-Bis-(4-hydroxy-3-n-dodecylcarbamoyl-I-naphthyloxycarbamino) toluene

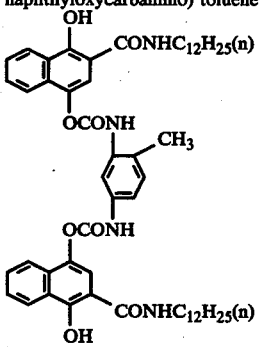

(8) I-Hydroxy-4-benzylaminocarbonyloxy-N-[δ-(3-n-dodecyloxyphenoxy)butyl]-2-naphthoamide

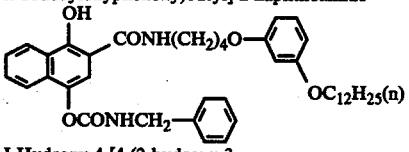

(9) I-Hydroxy-4-[4-(2-hydroxy-3,6-cisulfo-1-naphthylazo)anilinocarbonyloxy]-N-[δ-(3-n-dodecyloxyphenoxy)butyl]-2-naphthoamide (2) sodium salt -continued

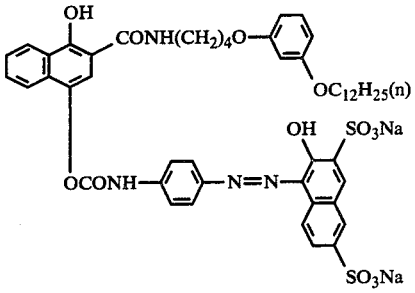

(10) I-Hydroxy-4-ethylaminocarbonyloxy-N-(s-n-tetradecyloxyphemyl)-2-naphthoamide

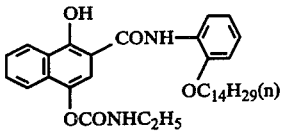

(11) I-Hydroxy-4-ethylaminocarbonyloxy-N-[β-(4-n-lauroylaminophenyl)ethyl]-2-naphthoamide

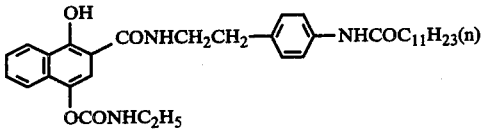

(12) Bis-{4-[4-hydroxy-3-[N-[β-(4-n-lauroyaminophenyl)ethyl] carbamoyl]-1-naphthyloxycarbamino]phenyl}methane

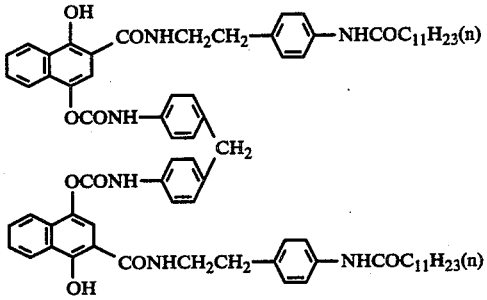

(13) I-Hydroxy-4-benzoylaminocarbonyloxy-N-[Y-(2,4-di-tert-amylphenoxyacetamino)propyl]-2-naphthoamide

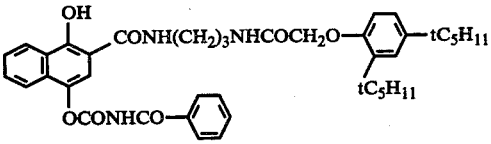

(14) I-Hydroxy-4-(4-chloroanilinocarbonyloxy)-N-[β-(n-octylthio-α-methylpropionoylamino)-ethyl]-2-naphthoamide

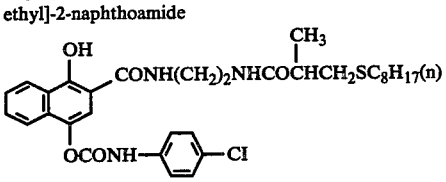

(15) I-Hydroxy-4-(3-toluylcarbonyloxy-N-n-octadecyl-N-(3,5-dicarboxypheny)-2-naphthoamide

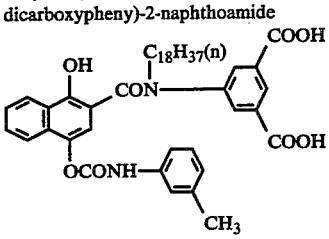

(16) I-Hydroxy-4-iso-butylaminocarbonyloxy-N-[β-(β-carboxy-β-octadecylpropionoylamino)-ethyl]-2-naphthoamide -continued

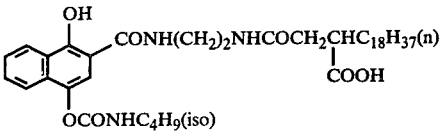

(17) I-Hydroxy-4-(2,4-di-tert-amylphenoxymethylaminocarbonyloxy)-N-[Y-(2,4-di-tert-amylphenoxy)propyl]-2-naphthoamide

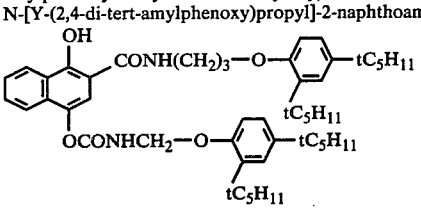

(18) I-Hydroxy-4-n-dodecylaminocarbonyloxy-N-ethyl-N-sulfoethyl-2-naphthoamide potassium salt

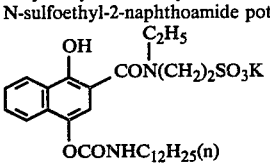

(19) I-Hydroxy-4-ethylaminocarbonyloxy-N-ethyl-(3,5-dicarboxyphenyl)-2-naphthoamide

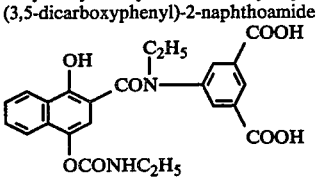

(20) I-Hydroxy-4-n-dodecylaminocarbonyloxy-N-ethyl-N-(3,5-dicarboxyphenyl)-2-naphthoamide

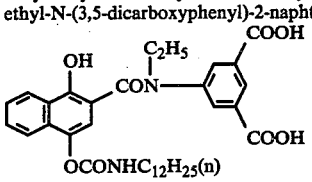

(21) I-Hydroxy-4-(N-phenyl-N-acetyl-aminocarbonyloxy)-naphthoanilide

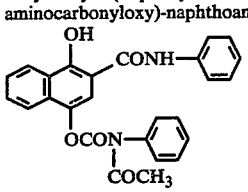

(22) I-Hydroxy-4-anilinocarbonyloxy-2-naphthomorpholide

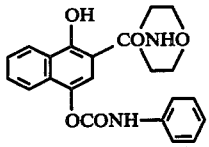

(23) I-Hydroxy-4-n-octadecylaminocarbonyloxy-2-naphthocyclohexylamide

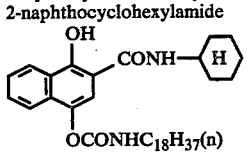

(24) 1,4-Phenylene-bis-(1-hydroxy-4-anilino-carbonyloxy-2-naphthoamide)

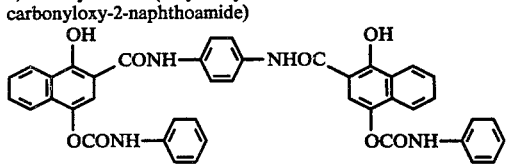

(25) 6-Chloro-5-methyl-4-anilinocarbony-loxy-2-acetoaminophenol

-continued

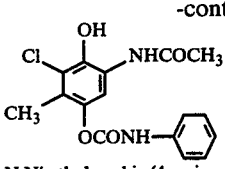

(26) N,N'-ethylene-bis-(4-aminocarbonyloxy-2,5-dichlorophenol)

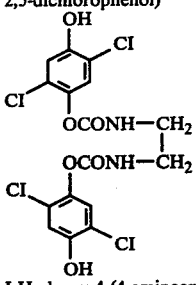

(27) I-Hydroxy-4-(4-aminoanilinocarbonyloxy-N-(2-n-tetradecyloxyphenyl)-2-naphtoamide

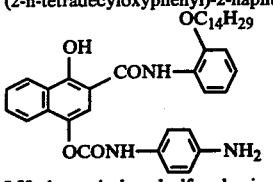

(28) I-Hydroxy-4-phenylsulfonylaminocarbonyloxy-N-[δ-(2,4-di-tert-amylphenoxy)butyl]-2-naphthoamide

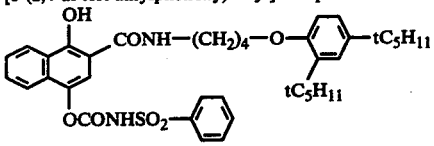

These compounds of this invention, for example, naphthol type couplers, can be prepared by refluxing and boiling a naphthol type coupler having a hydroxyl group at the 4-position of 1-naphthol (for example, 1,4-dihydroxy-2-naphthoanilide, 2,4-di-tert-amylphenoxybutyl-1,4-dihydroxy-2-naphthoamide, 1,4-dihydroxy-2-tetradecyloxyphenyl-2-naphthoamide, etc.) in a sufficiently dried suitable solvent (for example, toluene, xylene, dioxane, benzene, etc.) together with a suitable amount of a corresponding isocyanate, to thereby form a corresponding coupler in which the 4-position is substituted by an aminocarbonyloxy group. Further, such couplers can also be prepared from intermediates of the abovementioned 1,4-dihydroxynaphthol type couplers. For example, they can be prepared by reacting such intermediate (for example, phenyl, methyl and ethyl esters of 1,4-dihydroxy-2-naphthonic acid) with a corresponding isocyanate and heat-melting the resulting aminocarbonyloxy derivative together with a suitable amine (for example, aniline, 2,4-di-tert-amylphenoxybutylamine, 2-tetradecycloxyaniline, etc.), or by hydrolyzing the ester portion of the intermediate according to a customary method and reacting the resulting free carboxylic acid with a corresponding amine in the presence of dicyclohexylcarbodiimide. Other couplers can be prepared according to similar methods.

Further, phenol type couplers can be synthesized by protecting one of hydroxyl groups of a 1,4-dihydroxybenzene derivative with a benzyl group, reacting the protected 1,4-dihydroxybenzene derivative with a corresponding isocyanate in the same manner as in the case of the naphthol type coupler, and reducing the product by introduction of hydrogen according to a customary method. Other phenol type couplers can similarly be synthesized.

Typical instances of the synthesis of couplers of this invention will now be described more specifically.

Synthesis Example 1

0.01 mole of 1,4-dihydroxy-N-[ε-(2,4-di-tert-amylphenoxy)butyl-2-naphthoamide and 0.01 mole of phenyl isocyanate were dissolved in 100 ml of dehydrated toluene, and 0.02 mole of pyridine was added thereto and the solution was refluxed for 5 to 6 hours.

After completion of the reaction, the solvent was removed under reduced pressure, n-hexane was added to the residue, and crystals were recovered by filtration. The recovered crystals were recrystallized from ienzeme-petroleum benzine to obtain a compound having a melting point of 188° to 189.5° C. (the yield being 70%). From the results of the elementary analysis and the like, it was confirmed that the so obtained compound was coupler (1).

Synthesis Example 2

0.01 mole of of 1,4-dihydroxy-N-[ε-(2,4-di-tert-amylphenoxy)butyl]-2-naphthoamide and 0.01 mole of p-nitrophenyl isocyanate were dissolved in 100 ml of dehydrated toluene, 0.02 mole of pyridine was added thereto, annd the solution was refluxed for 1 to 1.5 hours. After completion of the reaction, the solvent was removed under reduced pressure, n-hexane was added to the residue, and crystals were recovered by filtration and recrystallized from benzene-petroleum benzine to obtain a compund having a melting point of 138.5° to 140° C. (the yield being 85%). From the results of the elementary analysis and the like it was confirmed that the resulting compound is coupler (3).

Synthesis Example 3

0.01 mole of 1,4-dihydroxy-N-(n-dodecy)-2-naphthoamide and 0.01 mole of p-nitrophenyl isocyanate were dissolved in 100 ml of dehydrated toluene, 0.02 mole of pyridine was added thereto, and the solution was refluxed for 1 to 1.5 hours. After completion of the reaction, the solvent was removed under reduced pressure, n-hexane was added to the residue, and crystals were recovered by filtration. The resulting nitro-compound was reduced with zinc and coupled with disodium 1-hydroxynaphthalene-3,6-disulfonate under alkaline conditions to obtain a compound having a melting point higher than 300° C. in a yield of 60%. From the results of the elementary analysis and the like it was confirmed that the compound was coupler (6).

Synthesis Example 4

0.01 mole of 1,4-dihydroxy-N-(2-n-tetradecyloxyphenyl)-2-naphthoamide and 0.01 mole of p-nitrophenyl isocyanate were dissolved in 60 ml of dehydrated toluene, 0.015 mole of pyridine was added thereto and the mixture was refluxed for 0.5 hour. After completion of the reaction, the solvent was removed under reduced pressure and crystals were recrystallized from acetone to obtain crystals melting at 158° to 159° C. in a yield of 90%. 0.005 mole of the so obtained nitro-compound was dissolved in 75 ml of dioxane and reduced with 0.016 mole of zinc powder and 38 ml of concentrated hydrochloric acid, and the resulting amine sodium salt was treated with an alkali to form a free amine. Recrystallization from benzene gave crystals melting at 166° to 169° C. in a yield of 65%. From the results of the elementary analysis and the like, it was confirmed that the resulting compound was coupler (27).

Synthesis Example 5

Coupler (1) obtained in Synthesis Example 1 could also be synthesized in the following manner.

0.01 mole of phenyl 1,4-dihydroxy-2-naphthalate and 0.01 mole of phenyl isocyanate were dissolved in 100 ml of dehydrated toluene, 0.02 mole of pyridine was added thereto, and the mixture was refluxed for 1 to 1.5 hours. After completion of the reaction, the solvent was removed under reduced pressure, n-hexane was added to the residue, and crystals were recovered by filtration. The so obtained urethanized product was incorporated with δ-(2,4-di-tert-amylphenoxy)butylamine, and the mixture was heated at 150° C. for 1.5 hours. The reaction product was incorporated with n-hexane, and crystals were recovered by filtration and recrystallized from benzene-petroleum benzine to obtain coupler (1) in a yield of 60%.

Various couplers can be synthesized according to methods similar to those described in the foregoing Synthesis Examples, and among these various couplers, those exemplified above are chosen and the results of the elementary analysis of them are shown below.

| Coupler No. | Elementary Analysis Values (%) Calculated Values C | H | N | Cl | S | Found Values C | H | N | Cl | S |
|---|---|---|---|---|---|---|---|---|---|---|
| (1) | 74.72 | 7.59 | 4.59 | — | — | 74.38 | 7.69 | 4.18 | — | — |
| (2) | 76.33 | 7.32 | 4.24 | — | — | 75.99 | 7.54 | 4.02 | — | — |
| (3) | 69.59 | 6.92 | 6.41 | — | — | 69.81 | 7.02 | 6.39 | — | — |
| (4) | 72.36 | 7.91 | 5.14 | — | — | 72.01 | 8.03 | 5.05 | — | — |
| (5) | 68.62 | 7.10 | 5.34 | 6.75 | — | 68.85 | 7.09 | 5.22 | 6.38 | — |
| (6) | 55.55 | 4.89 | 6.48 | — | 7.41 | 55.59 | 4.91 | 6.42 | — | 7.39 |
| (7) | 72.02 | 7.91 | 6.11 | — | — | 71.87 | 7.79 | 5.98 | — | — |
| (8) | 73.62 | 7.84 | 4.19 | — | — | 73.87 | 7.81 | 4.20 | — | — |
| (9) | 58.35 | 5.29 | 5.45 | — | 6.23 | 58.07 | 5.22 | 5.47 | — | 6.41 |
| (10) | 72.57 | 8.24 | 4.98 | — | — | 72.47 | 8.21 | 4.83 | — | — |
| (11) | 70.93 | 7.88 | 7.30 | — | — | 71.03 | 7.92 | 7.34 | — | — |
| (12) | 73.42 | 7.20 | 6.67 | — | — | 73.58 | 7.27 | 6.89 | — | — |
| (13) | 70.64 | 6.95 | 6.16 | — | — | 70.78 | 7.02 | 6.22 | — | — |
| (14) | 62.58 | 6.57 | 6.84 | 5.77 | 5.21 | 62.80 | 6.71 | 6.52 | 5.44 | 5.08 |
| (15) | 71.78 | 7.50 | 3.72 | — | — | 71.52 | 7.61 | 3.45 | — | — |
| (16) | 68.84 | 9.10 | 6.02 | — | — | 69.08 | 9.23 | 5.91 | — | — |
| (17) | 75.16 | 8.67 | 3.65 | — | — | 74.87 | 8.74 | 3.85 | — | — |
| (18) | 57.11 | 7.02 | 4.76 | — | 5.45 | 57.42 | 7.18 | 4.64 | — | 5.50 |
| (19) | 61.80 | 4.76 | 6.01 | — | — | 61.63 | 4.81 | 5.82 | — | — |
| (20) | 67.31 | 6.98 | 4.62 | — | — | 67.75 | 7.18 | 4.93 | — | — |
| (21) | 70.90 | 4.58 | 6.36 | — | — | 70.64 | 4.60 | 6.48 | — | — |
| (22) | 67.33 | 5.14 | 7.14 | — | — | 67.59 | 5.30 | 7.09 | — | — |
| (23) | 74.44 | 9.72 | 4.82 | — | — | 74.72 | 9.84 | 4.55 | — | — |
| (24) | 70.19 | 4.21 | 7.80 | — | — | 69.87 | 4.04 | 8.03 | — | — |
| (25) | 57.40 | 4.52 | 8.37 | 10.59 | — | 57.04 | 4.38 | 8.29 | 10.18 | — |
| (26) | 40.88 | 2.57 | 5.96 | 30.17 | — | 40.72 | 2.48 | 6.02 | 30.55 | — |
| (27) | 72.93 | 7.57 | 6.71 | — | — | 73.17 | 7.55 | 6.66 | — | — |
| (28) | 67.64 | 6.87 | 4.15 | — | 4.74 | 67.81 | 6.82 | 4.28 | — | 4.89 |

The so obtained couplers of this invention are characterized by a high dye-forming speed and they exhibit, as mentioned above, a much higher dye-forming speed at the color development than conventional 4-equivalent type cyane couplers. Further, their dye-forming speed is higher than that of a 2-equivalent type coupler having as the split-off group aryloxy group such as phenoxy and nitrophenoxy groups or that of a 2-equivalent type coupler having as the split-off group an ester-linkage group such as acetoxy and benzoyloxy groups. Moreover, as compared with conventional couplers having a relatively analogous structure, the couplers of this invention can easily be dispersed ina protective colloid such as a gelatin. Among the couplers of this invention, oil-soluble couplers have an excellent solubility in coupler solvents, and couplers having a hydrophilic group exhibit excellent characteristics in Fischer dispersion. The couplers of this invention can easily be added to a liquid developer (these coupler are called as external coupler hereinafter). By virtue of these excellent characteristics, especially when the couplers of this invention are incorporated into photosensitive layers of photographic photosensitive materials, the thickness of the photosensitive layer can be greatly reduced, the sharpness and other properties of resulting dye images can be improved, and no bad interaction is shown at the color development (these coupler are called as internal coupler hereinafter). Still further, by virtue of good reactivity, color contamination and the like can be highly improved with use of the couplers of this invention.

As pointed above, dyes obtained by employing the couplers of this invention have excellent color absorption characteristics.

As is apparent from the foregoing description, the couplers of this invention have varius applicabilities and they are used for attaining various objects by choosing a suitable combination of the coupler substrate and split-off group. For example, couplers having a water-soluble group such as sulfonyl and carboxyl groups in the cyane coupler residue have good dispersibility, and couplers in which the bonding group-containing split-off group per se has dispersibility can be used as diffusible couplers. These couplers are utilized in the so called external photography coupter-in-developer type and can be incorporated into, for example, a color-forming liquid developer. For instance, coupler (19) can be mentioned as a coupler of this type.

Couplers of this invention in which the cyane coupler residue has dispersibility, the split-off group has appropriate non-dispersibility because it has such a non-dispersible group such as an aliphatic long-chain hydrocarbon residue, e.g., an octadecyl group but the entire structure consisting of such cyane coupler residue and split-off group has dispersibility, can be utilized in the external photography as well as the above-mentioned type couplers.

Couplers (21), (22), (25) and (26) can be mentioned as preferred couplers for the external photograpahy in addition to the above-mentioned coupler (19).

As is well known in the art, in the external photography, a coupler is incorporated into a color-forming liquid developer, and a coupler-free photosensitive material, especially a silver halide photosensitive material for black-white photography (prepared for the external photography), is exposed to light and developed with the coupler-containing color-forming liquid developer. On the development, the color-forming developing agent and coupler intrude into the photosensitive material and the color-forming developing agent reacts with the diffusible coupler in the presence of a silver halide having the center of development, with the result that a dye image is formed. In order to obtain a multicolor image, the development is generally carried out by employing successively color-forming liquid developers containing different couplers (for example, a cyane couper, a magenta coupler and a yellow coupler).

Such color-forming liquid developer can comprise, in addition to the color-forming developing agent and coupler, various photographic additives used in ordinary color-forming liquid developers, such as sulfites, carbonates, bisulfites, bromides and iodides of alkali metals, and the like. A typical instance of the composition of such liquid developer is as follows:

| Composition of Color-Forming Liquid Developer: | |
|---|---|
| Color-forming developing agent | 1 - 5 g |
| Anhydrous sodium sulfite | 1 - 3 g |
| Anhydrous sodium carbonate | 10 - 60 g |
| Potassium bromide | 0.5 - 1.5 g |
| Coupler | 1 - 3 g |
| Water | balance |
| Total | 1 liter |

An external color-forming liquid developer containing a coupler of this invention, especially one suitable for the external photography such as mentioned above, has a good solubility as compared with liquid developers comprising conventional couplers and exhibits excellent properties such as mentioned above.

Couplers in which the cyane coupler residue is diffusible, the split-off group is diffusible but the entire coupler structure is non-diffusible, couplers in which the cyane coupler residue is non-diffusible, the split-off group is diffusible but the entire coupler structure is non-diffusible, and couplers in which the cyane coupler residue is non-diffusible, the split-off group is diffusible and the entire coupler structure is diffusible, are suitable for use in the diffusion transfer type photographic precess. Imparting diffusibility to each group can be accomplished by selecting a low-molecular-weight group and or introducing a water-soluble hydroxyl group such as a sulfonyl group and the like. Imparting non-dispersibility to each group can be accomplished by introducing a long-chain aliphatic hydrocarbon residue and / or selecting a relatively high-molecular-weight group.

As a spscific instance of the coupler to be used for the diffusion transfer type photography, there can be mentioned couplers in which chemical seeds unnecessary for image formation at color-forming development though either the cyane coupler residue or the split-off group is diffusible. For example, couplers formed by introducing a hydroquinene residue, a resorcin residue or the like into either of the cyane coupler residue and split-off group through or without an appreprate bonding group can be effectively used for the diffusion transfer photography, and this means can be applied to other type couplers differing in the combination of dispersibility and non-dispersibility between the cyane coupler residue and split-off group. When the diffusion transfer type photographic process is adopted, the image forming method is divided into two types, one utilizing a cyane dye obtained by the reaction between the cyane coupler residue and color-forming developing agent, and the other utilizing the split-off group portion isolated at color development. In the former method, it is necessary that the obtained cyane dye is diffusible, and in the latter method, it is indispensable that a compound formed by isolation of the split-off group from the active position is diffusible. When such isolated compound is utilized, it is necessary that said compound should be colored. In short, such compound includes a dye content such as an azo dye. Examples of the split-off group of this type are represented by the following general formula [VII]:

$$\mathrm{OCO-\underset{\underset{R}{|}}{N}-D} \qquad \text{[VII]}$$

wherein R is as defined above and R may be D, and D stands for a residue of a dye.

In the general formula [VII], the dye residue D has preferably a water-soluble group and it is preferred that the dye residue D is a monovalent residue of a dye selected from azo dyes, azomethine dyes, indoaniline dyes, indophenol dyes and anthraquinons dyes.

As the coupler suitable for the diffusion transfer type photographic process, there can be mentioned, for example, couplers (6), (9), (18), (20) and (23).

As is well known in the art, a combination of a photosensitive material and an image-receiving material is employed in the diffusion transfer type photography, and according to this photographic method, after exposure of the photosensitive material, it is superposed on the image-receiving material at least during the development step to form an image on the image-receiving material. For instance, a coupler-containing silver halide photosensitive material is used in combination with an image-receiving material comprising an image-receiving layer formed on a support through an undercoat layer, an intermediate layer and the like. After exposure of the silver halide photosensitive material, the photosensitive layer of the photosensitive material is superposed on the image-receiving layer of the image-receiving material, if desired, through a protective layer, and a color-forming liquid developer is intruded into the clearance between the two layers to effect development. Thus, the dye formed on the photosensitive layer is transferred onto the image-receiving layer by diffusion, and finally, the image-receiving material is peeled off from the photosensitive material, whereby a dye image is formed on the image-receiving material. Various methods are known as such diffusion transfer type photographic process. For instance, there can be mentioned a method in which the photosensitive material is integrated with the image-receiving material and the steps of superposing the image-receiving material and photosensitive material and peeling off the image-receiving material from the photosensitive material are omitted. In this method, if a boundary layer between the image-receiving material and photosensitive material or a layer adjacent thereto is an opaque layer, a support for the photosensitive material is transparent and light exposure is effected from the side of the support of the photosensitive material. If a boundary layer or a layer adjacent thereto is substantially transparent, in order for the resulting image not to be influenced by the image formed in the photosensitive material, at least one of the above layers should be specified at the stop conducted after the light exposure, for instance, at the color-forming development stop, and in this type combination of the image-receiving material and photosensitive material, at least a support on the side of the image-receiving material should be transparent and the light exposure is effected from the side of the image-receiving material. After the light exposure, a color-forming liquid developer is intruded into the boundary between the photosensitive material and image-receiving material or in the vicinity thereof, and an image is formed on the image-receiving layer.

In another diffusion transfer type photographic method, a color-forming liquid developer is retained in advance in an image-receiving material, and the development and transfer treatments are performed only by superposing such image-receiving material on a photosensitive material.

Couplers of this invention can be applied effectively to any of known diffusion transfer photographic methods. In general, the coupler is incorporated in a photosensitive material and use of a silver halide photosensitive material is preferred. The coupler is generally used in an amount of about 0.07 to about 0.7 mole, preferably 0.1 to 0.4 mole, per mole of the silver halide.

A coupler known as the so called internal coupler is used in the state incorporated in a photosensitive material, especially a silver halide photosensitive material. In order not to impose influences on other layers, it is preferred that the coupler used is non-diffusible. Among couplers to be used for the above-mentioned diffusion transfer photography, those that are non-diffusible can also be used effectively. It is preferred that a coupler in which the cyane coupler residue is non-diffusible and the split-off group is either diffusible or non-diffusible is used as the internal coupler.

Preferred instances of the coupler of this type are couplers (1), (2), (3), (4) (5), (6), (7), (8), (9) (10) (11), (12), (13), (14), (15), (16), (17), (24) and (27).

Some internal couplers are substantially colorless and are ordinary couplers capable of forming a dye by the reaction with an oxidation product of the color-forming developing agent formed at the development step. Other internal couplers are colored coupers and are preferably used for color correction in the so called masking process. For color correction in the masking process, couplers (6) and (9) of this invention are preferably employed. In color correction in the masking process, the color of the colored coupler per se is decolorized or is excluded from the system of the photosensitive material at color-forming development, and simultaneously, a cyane dye is formed by its reaction with a color-forming developing agent. In general, a colored coupler of this type is used in combination with a substantially colorless coupler.

Internal couplers are divided into two types depending on whether they contain in the molecule a hydrophilic group or an oleophilic group. Namely, they are divided into the Fischer dispersion type which is incorporated in the form of an alkaline liquid into a coating composition for formation of a photosensitive layer and the protect type which is incorporated in the state dissolved in a coupler solvent. As the former type, there can be typically mentioned couplers (15) and (16). When the couplers of this invention are dispersed by appropriate means depending on the above-mentioned types, they exhibit a much higher solubility than conventional couplers, and hence, they can provide such advantages as formation of a higher density image, improvement of the layer transparency and the resolving power.

In case a coupler of this invention is incorporated into a photosensitive material, it is generally used in an amount of about 0.07 to about 0.7 mole, preferably 0.1 to 0.4 mole, per mole of a silver halide. In case a coupler of this invention is used for color correction in the masking process or it is used for improving characteristics of other coupler or for other purposes, the coupler is generally used in an amount of about 0.01 to about 0.1 mole, preferably about 0.03 to about 0.07 mole, per mole of a silver halide.

As described hereinabove, couplers of this invention can be applied in various manners depending on intended purposes, and they exhibit excellent characteristics in any application.

A preferred photosensitive material to which the coupler of this invention is applied is a silver halide photosensitive material, and the coupler of this invention can be used for various silver halide photosensitive materials. For example, the coupler of this invention can be ued for silver halide photosensitive materials for the above-mentioned diffusion transfer type photography, ordinary negative photosensitive materials, ordinary reversal photosensitive materials, ordinary positie photosensitive materials, direct positive phhotosensitive materials, special photosensitive materials (such as photosensitive materials for printing, X-ray photosensitive materials, high resolving power photosensitive materials, infrared photosensitive materials and ultraviolet photosensitive materials), and other silver halide photosensitive materials.

As the siver halide to be used for such photosensitive materials, there can be mentioned, for example, silver chloride, silver iodide, silver iodobromide, silver chlorobromide, silver chloroidobromide, etc. These silver halides are prepared according to various methods such as the neutral method, the ammonia method, the simultaneous mixing method and coversion method, and a suitable method is chosen depending on the intended type of the photosensitive material. In the case of a mixed silver halide, the mixing ratio of two or more of silver halides is appropriately chosen. For example, a silver halide having a relatively low sensitivity and a relatively fine particle size is composed mainly of silver chloride, and the content of silver chloride is reduced in a mixed silver halide having a relatively high sensitivity. As the silver halide used for a direct positive photosensitive material, there can be mentioned, for example, Herschel reversal type silver halides and solarization type silver halides, and in general, appropriate chemical or optical fogs are imparted in advance to these silver halides. Further, these silver halides are chemically sensitized by active gelatin; sulfur sensitizers such as allylthiocarbamide, thiourea and cysteine selenium sensitizers; reducing sensitizers such as stannous salts and polyamines; and noble metal sensitizers such as gold sensitizers, e.g., potassium aurithiocyanate, potassium chloroaurate and 2-aurosulfobenzothiazole methochloride, and sensitizing amounts of water-soluble salts of ruthenium, rhodium, irridium and the like, e.g., ammonium chloropalladate, potassium chloroplatinate and sodium chloropalladide (some of these sensitizers act as a sensitizer or as a fog inhibitor depending on the amount used). These sensitizers can be used singly or in the form of a mixture of two or more of them. For example, a combination of a gold sensitizer and a sulfur sensitizer and a combination of a gold sensitizer and a selenium sensitizer are used for the chemical sensitization.

Silver halides can be optically sensitized in a desired wavelength region. For example, they can be optically sensitized (for example, hypersensitized) by one or more of cyanine dyes such as zeromethine dyes, monomethine dyes, dimethine dyes and trimethine dyes, meroeyanine dyes, and other optical sensitizers.

Such silver halide is dispersed in a suitable protective colloid to form a photosensitive layer. As the protective colloid to be used for formation of a photosensitive layer and other structural layers such as an intermediate layer, a protective layer, a filter layer, an image-receiving layer and a pH-adjusting layer (for example, an undercoat of the image-receiving layer), gelatine is generally employed, and in addition, there are employed colloidal albumin, cellulose derivatives, polyvinyl compounds (for example, polyvinyl alcohol) and other synthetic resins. They can be used singly or in the form of a mixture of two or more of them. Further, it is possible to employ acetyl cellulose having an acetyl content of about 19 to about 26% of water-soluble ethanolamine cellulose acetate in combination with the foregoing protective colloids.

As the support of a photosensitive material, there can be employed paper, laminate paper (for example, a laminate of polyethylene and paper), glass, and a film or sheet of such a suubstrate as cellulose acetate, cellulose nitrate, polyester, polycarbonate, polyamide, polystyrene and polyolefin. In erder to improve the adhesive property of such support to each structural layer, the support can be subjected to various surface treatments for rendering it hydrophilic. For example, the support can be subjected to the saponification treatment, the corona discharge treatment, the undercoat treatment, the setting treatment and the like.

A photosensitive material comprises at least a support and a photosensitive layer formed thereon. In general, a photosensitive material has a multilayer structure composed of at least several layers in which suitable layers are so disposed at various positions as to attain objects such as mentioned above. For example, a photosensitive material for color photography can include at least two photosensitive layers sensitized in different wavelength regions and each photosensitive layer can contain a coupler forming a color different from the color of the coupler contained in the other photosensitive layer.

Since a cyane coupler residue portion is utilized in the coupler of this invention, a cyane dye is formed, and the coupler of this invention forming a cyane dye is used for a photosensitive material for color photography in combination with other 2-equivalent and 4-equivalent type couplers such as magenta couplers, e.g., 5-pyrazoles, and yellow couplers having an active methylene group inserted between two carbonyl groups. In a pseudocolor photosensitive material, the coupler of this invention can be used singly or in combination with a similar cyane coupler, and the reaction between the sensitive wavelength region and the coupler is not always in agreement with said relation in an ordinary color photosensitive material.

A photosensitive layer sensitive to a certain wavelength region may comprise two or more layers differing in the sensitivity, and couplers forming the same color but differing in the type, for example, a combination of 2-equivalent type and 4-equivalent type couplers, can be incorporated into respective layers. Such multilayer photosensitive layer is adopted for further improving the resolving power or attaining other objects.

As pointed above, the coupler of this invention can be combined with other 2-equivalent type or 4-equivalent type couplers. For example, so called colored couplers (having a split-off group including as a bonding group an azo group at the active point), so called D. I. R. couplers (releasing a development inhibitor at the development step) and the like can be combined as the 2-equivalent type coupler.

A photographic photosensitive material can contain various photographic additives in the photosensitive layer and/or other structural layers (such as intermediate, undercoat, filter, protective and image-receiving layers), and as such photosensitive additive there can be employed, for example, stabilizers such as mercury compounds, triazoles, azaindenes, zinc salts and cadmium salts, sensitizers such as quaternary ammonium salts and polyethylene glycol, film property-improving agents such as glycerin, dihydroxyalkanes, esters ethylene-bis-glycolic acid and emulsions or dispersions of polymers, film-hardening agents such as formaldehyde, halogen-substituted fatty acids, disulfonyl chloride, bisaziridine and ethyleneimines, extenders such as saponin, lauryl and oleyl monoethers of polyethylene glycol and sulfated and alkylated polyethylene glycol salts, organic solvents such as coupler solvents (high-boiling-point organic solvents and/or low-boiling point organic solvents, for example, dibutyl phthalate, tricrezyl phosphate, acetone, mthanol, ethanol and ethylene cellosolve), so called D. I. R. compounds capable of releasing a development inhibitor and forming a substantially colorless compound at the development step, antistatic agents, defoaming agents, ultraviolet adsorbers, fluorescent whitening agents, slop-preventive agents, matting agents, halation-preventive agents and irradiation-preventive agents. These photographic additives can be used singly or in combination.

An image-receiving material which is an individual layer independent from a photosensitive material and is used for the diffusion transfer type photography in combination with a photosensitive material comprises at least an image-receiving layer formed on a support such as mentioned above, and it may further comprise a protective layer, an undercoat layer, a pH-adjusting layer and the like according to need. Each layer comprises a protective colloid such as mentioned above as a layer-forming material, and various photographic additives such as mentioned above can be incorporated therein according to need. For example, in order to prevent re-diffusion of a diffusible dye diffused from the photosensitive layer or color bleeding at the color development of the image-receiving layer, it is desired that a compound having a capacity of catching a dye or a compound having an ability to annul the dispersibility of a dye is incorporated into the image receiving layer. It is also possible to incorporate such compound into a layer adjacent to the image-receiving layer. Typical instances of such compound are mordants such as polymers of an aminoguanidine derivative of vinylmethylketone disclosed in the specification of U.S. Pat. No. 2,882,156 and mordants disclosed in the specifications of U.S. Pat. Nos. 3,271,148 and 3,271,147 and pH-adjusting agents such as inorganic and organic acids.

As pointed above, a color-forming liquid developer for color formation and development of an exposed photosensitive material comprises as a main ingregient a developing agent. As the developing agent, there are typically employed p-phenylenediamines such as diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, N-ethyl-N-β-meethanesulfonamidoethyl-3-methyl-4-aminoaniline sulfate, N-ethyl-N-β-methanesulfonamidoethyl-4-aminoaniline, 4-N-ethyl-N-β-hydroxy-ethylaminoaniline and the like.

These developing agents can be used singly, or mixtures of two or more of them may be used. These developing agents can be used, if desired, in combination with developing agents for black-white photography, such as hydroquinone and the like. Further, these developing agents for color photography can contain alkalis such as sodium hydroxide, ammonium hydroxide, sodium carbonate, sodium sulfate and sodium sulfite and other various additives such as alkali metal halides, e.g., potassium bromide and development-adjusting agent, e.g., citrazinic acid. In some diffusion transfer type photographic methods, this developing agent for color photography is incorporated in advance into an image-receiving material. In such methods, the color-forming developing agent is separated from the alkali, and only one of the developing agent and alkali is incorporated into the image-receiving layer and it is treated with a liquid containing the other component at the development step.

The coupler of this invention reacts with an oxidation product of the color-forming developing agent formed on development of a silver halide with such color-forming liquid developer to form a cyane dye, and some couplers provide other dyes (inclusive of cyane dyes).

In case the silver halide contained in the photosensitive material or developed silver is removed outside the system after such color-forming development treatment, a fixing liquid, a bleaching liquid, a combination of a fixing liquid and a bleaching liquid, a bleaching fixing liquid and the like are employed. Treatments with these liquids are conducted in combination with other treatments such as water-washing treatment, stopping treatment, stabilizing liquid treatment and the like. As the fixing component, there can be employed, for example, solvents for silver halides such as sodium thiosulfate and ammonium thiosulfate, and as the bleaching component, there can be employed, for example, red prussiate, and ammonium, ferric and sodium salts of ethylenediamine tetraacetic acid.

This invention has the above-mentioned structure, and as detailed hereinabove, the coupler of this invention is superior to conventional 2-equivalent type couplers in varius photographic characteristics.

This invention will now be described more detailedly by reference to the following Examples which by no means limit the scope of this invention.

EXAMPLE 1

10 g of a coupler indicated in Table 1 given below was added to a liquid mixture of 20 ml of dibutyl phthalate and 60 ml of ethyl acetate, and the mixture was heated at 60° C. to dissolve the coupler completely. The resulting solution was mixed with 5 ml of a 10% aqueous solution of Alkanol B (alkylnaphthalene sulfonate manufactured by Du Pont) and 200 ml of a 5% aqueous solution of gelatin, and the mixture was emulsified by means of a colloid mill to form a coupler dispersion.

The so formed dispersion was added to 500 g of a gelatin emulsion for negative including silver iodobromide (containing 6.0 mole % of silver iodide), and the mixture was coated and dried on a cellulose triacetate film base.

The so obtained sample was exposed to light and developed at 20° C. for 10 minutes with a color-forming liquid developer having the following composition:

| | |
|---|---|
| N-ethyl-N-β-methanesulfonamidoethyl-3-methyl-4-aminoaniline sulfate | 5.0 g |
| Anhydrous sodium sulfite | 2.0 g |
| Sodium carbonate (monohydrate) | 50.0 g |
| Potassium bromide | 1.0 g |
| Sodium hydroxide | 0.55 g |
| Benzyl alcohol | 4.0 ml |
| Water | balance |
| Total | 1 liter |

The so treated sample was subjected to customary stopping and fixing treatments and washed with water for 10 minutes. Then, the sample was bleached at 20° C. for 5 minutes with a bleaching liquid having the following composition:

| | |
|---|---|
| Red prussiate | 100 g |
| Potassium bromide | 50 g |
| Water | balance |
| Total | 1 liter |

Then, the sample was washed with water for 5 minutes, and subjected to the fixing treatment at 20° C. for 5 minutes by employing a fixing liquid having the following composition:

| | |
|---|---|
| Sodium thiosulfate (pentahydrate) | 250 g |
| Water | balance |
| Total | 1 liter |

The sample was washed with water for 25 minutes and then dried.

The so treated sample was tested with respect to photographic characteristics to obtain results shown in Table 1.

Table 1

| Sample No. | Coupler Used | Relative Sensitivity | δ-Value | Maximum Density (Dmax) | Absorption Maximum Wavelength (max) | Image Photo-resistance | Image Moisture Resistance |
|---|---|---|---|---|---|---|---|
| 1 | coupler (1) | 163 | 1.83 | 2.44 | 700nm | 92% | 73% |
| 2 | coupler (5) | 138 | 1.67 | 2.41 | 700 nm | 87% | 70% |
| 3 | comparative coupler (1) | 100 | 1.60 | 2.28 | 700 nm | 90% | 65% |

In the above Table, the value of the sensitivity is a relative valve calculated based on the sensitivity (100) of the sample 3 using comparative coupler (1) disclosed in the specification of U.S. Pat. No. 2,474,239, which has the fellowing structurs:

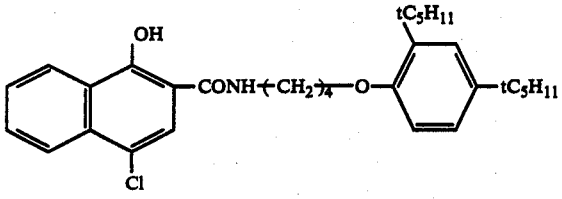

The photo-resistance of each sample was determined by subjecting each resulting image to exposure for 16 hours by employing a xenon fadometer and expressing the residual density in terms of the percentage based on the density (100) before the exposure. The moisture resistance was determined by storing the resulting image under a condition of a relative humidity of 80% for 2 weeks and expressing the residual density in terms of the percentage based on the density (100) before the storage test.

As is apparent from the results shown in Table 1, the coupler of this invention has excellent photographic characteristics (high sensitivity, excellent photo-resistance, excellent moisture resistance and the like), and a sample using the coupler of this invention provides a dye image having a high sharpness.

When the above procedures were repeated by employing couplers (2), (10), (13) and (17) instead of couplers (1) and (5), it was found that each of them has similarly excellent photographic characteristics as the internal coupler.

EXAMPLE 2

10 g of coupler (8) of this invention was added to a liquid mixture of 20 ml of dibutyl phthalate and 60 ml of ethyl acetate, and the mixture was heated at 60° C. to dissolve the coupler completely. The resulting solution was incorporated into 200 ml of a 5% aqueous solution of gelatin together with 5 ml of a 10% aqueous solution of Alkanol B. The mixture was emulsified by means of a coloid mill to form a coupler dispersion.

The resulting dispersion was added to 500 g of a red-sensitive, highly sensitized emulsion of silver iodobromide (containing 4.0 mole % of silver iodide), and the mixture was coated and dried on a cellulose acetate film base to obtain a photosensitive material having a stable coating.

In the same manner as described in Example 1, this photosensitive material was exposed to light and developed at 21° C. for 12 minutes with a liquid developer having the following composition:

| | |
|---|---|
| Metol | 3.0 g |
| Anhydrous sodium sulfite | 50.0 g |
| Hydroquinone | 6.0 g |
| Anhydrous sodium carbonate | 40.0 g |
| Potassium bromide | 3.5 g |
| Potassium thiocyanide | 2.0 g |
| Water | balance |
| Total | 1 liter |

The developed sample was subjected to customary stopping, film-hardening and water-washing treatments and then it was subjected to secondary exposure to white light.

Then, the sample was subjected to color-forming development at 21° C. for 13 minutes by employing a color-forming liquid developer having the following composition:

| | |
|---|---|
| N,N-diethyl-2-methyl-p-phenylenediamine | 3.0 g |
| Anhydreus sodium sulfite | 4.0 g |
| Sodium carbonate (monohydrate) | 20.0 g |
| Potassium bromide | 2.0 g |
| Water | balance |
| Total | 1 liter |

The sample was subjected to stopping, water-washing, bleaching and fixation according to customary methods, washed for 20 minutes with running water and dried to obtain a positive colored image of a cyane dye having an adsorption maximum at 700 nm and being excellent in transparency.

From the foregoing results, it will readily be understood that the coupler of this invention exhibits excellent photographic characteristics also when it is used for a reversal photosensitive material.

When the above procedures were repeated by employing coupler (10) instead of the coupler (8), good results were similarly obtained.

EXAMPLE 3

2.0 g of a coupler indicated in Table 2 given below was dissolved in 2.0 ml of tricrezyl phosphate and 6.0 ml of ethyl acetate, and a coupler-emulsified dispersion was prepared in the same manner as in Example 1. The resulting dispersion was added to 100 ml of a highly sensitized silver iodobromide emulsion, and the mixture was coated and dried on a film base to obtain a photosensistive material.

The so obtained photosensitive material was exposed to light according to a customary method and developed at 38° C. for 3 minutes and 15 seconds with a color-forming liquid developer having the following composition:

| | |
|---|---|
| N-ethyl-N-(β-hydroxyethyl)-3-methyl-4-aminoaniline hydrochloride | 5.0 g |
| Anhydrous sodium sulfite | 2.0 g |
| Sodium carbonate | 50.0 g |
| Potassium bromide | 1.0 g |
| Sodium hydroxide | 0.55 g |
| Water | balance |
| Total | 1 liter |

Then, the sample was bleached at 38° C. for 6 minutes with a bleaching liquid having the following composition:

| | |
|---|---|
| Sodium ethylenediamine tetraacetate | 40.0 g |
| Ferric chloride | 30.0 g |
| Sodium carbonate (monohydrate) | 20.0 g |
| Potassium bromide | 30.0 g |
| Water | balance |
| Total | 1 liter |

Then, the sample was subjected to water washing, fixation and stabilizing liquid treatments according to customary methods to obtain a positive image having an absorption maximum at 700 nm and exhibiting an excellent color.

The photographic properties of the resulting sample were determined to obtain results shown in Table 2.

In the Table, the value of the sensitivity is a relative value calculated based on the sensitivity (100) of a comparative coupler (2) disclosed in the specification of U.S. Pat. No. 3,034,892, which has the following structure:

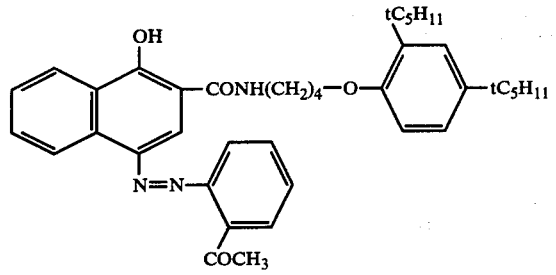

Table 2

| Sample No. | Coupler Used | Relative Sensitivity | Maximum Density (Dmax) | Absorption Maximum Wavelength (λmax) | Maximum Absorption Wavelength of Mask (λmax) |
|---|---|---|---|---|---|
| 4 | coupler (6) | 147 | 1.9 | 700 | 500 |
| 5 | coupler (9) | 153 | 2.1 | 700 | 500 |
| 6 | comparative coupler (2) | 100 | 1.7 | 700 | 500 |

In the above Table, the absorption maximum wavelength of the mask is an absorption maximum wavelength of coloration of the coupler per se.

In this Example, the coupler of this invention was used as a coupler for color correction in the so called masking process. As is apparent from the results shown in Table 2, the coupler of this invention has excellent photographic characteristics also in this case and it is highly improved over conventional couplers with respect to the sensitivity and density. Furthermore, the sharpness of the image can be highly improved by the coupler of this invention and an excellent dye image can be obtained.

EXAMPLE 4

Coupler (15) of this invention was incorporated into an ordinary highly sensitized emulsion for negative having silver iodobromide according to Fischer dispersion method (the coupler was used in an amount of 0.2 mole per mole of the silver halide). The emulsion was coated and dried on a cellulose triacetate film base according to a customary method.

The so obtained sample was light-exposed and treated at 24° C. for 3 minutes with an alkaline liquid developer having the following composition:

| | |
|---|---|
| Sodium sulfite | 2.0 g |
| 4-N-ethyl-N-β-hydroxyethylaminoaniline | 11.0 g |
| Water | balance |
| Total | 1 liter |

During the above development treatment, the photosensitive layer of the above sample was closely contacted with an image-receiving layer of an image-receiving material comprising a polyethylene-coated paper base and, formed thereon, an image-receiving layer containing dimethyl-β-hydroxyethyl-γ-steroamidopropylammonium-hydrogen phosphate. After the development treatment, the image-forming material was peeled off from the photosensitive material. A clear cyane positive image having excellent photographic characteristics was thus formed on the image-receiving material. From the results of this Example, it will readily be understood that the coupler of this invention is excellent also as a coupler for the diffusion transfer type photography.

EXAMPLE 5

Coupler (19) of this invention was dissolved in methanol, and by employing this solution, an external color-forming liquid developer having the following composition was prepared:

| | |
|---|---|
| N,N-diethyl-2-methyl-p-phenylenediamine | 2.0 g |
| Anhydrous sodium sulfite | 2.0 g |
| Sodium carbonate (monohydrate) | 20.0 g |
| Potassium bromide | 1.0 g |
| Coupler (19) | 2.0 g |
| Water | balance |
| Total | 1 liter |

A highly sensitized silver iodobromide emulsion was coated on an undercoated film of polyethylene terephthalate, and the sample was light-exposed and developed at 24° C. for 3 minutes with the above external color-forming liquid developer.

The developed sample was water-washed for 4 minutes, bleached for 5 minutes, water-washed for 5 minutes, fixed for 5 minutes, water-washed for 30 minutes and dried according to customary treatment methods. As a result there was obtained a cyane image excellent in spectral absorption characteristics at an absorption maximum wavelength of 700 nm and in other photographic characteristics.

When the above procedures were repeated in the same manner by employing coupler (25) instead of the above coupler (19), an excellent dye image having an absorption maximum wavelength of 680 nm was obtained.

From the results of this Example, it will readily be understood that the coupler of this invention is valuable also as an external coupler.

EXAMPLE 6

Dispersion A:

Prepared by the same manner as Example 1 except using a solution that 0.15 of the coupler (6) and 2.0 g of I-hydroxy-N-[8-(2.4-di-t-amylphenoxy)butyl]-2-naphtoamide which is known are dissolved in the mixture of 2.2 ml of tricresylphosphate and 6.0 ml of ethylacetate.

Dispersion B:

0.2 g of 2-(I-phenyl-5-tetrazolylthio)-4-2-2.4-di-t-amylphenoxy) acetamide, indanone (developing inhibitor releasing type compound) is added to the dispersion A.

Dispersion C:

0.1 of 1-hydroxy-4-(1-phenyl-5-tetrazolylthio)2-(tetradecyloxyphenyl) naphtoamide (developing inhibitor releasing type coupler) is added to the dispersion A.

Dispersion D:

Same as the dispersion B except that the comparative coupler (2) is used indead of the coupler (6).

These dispersions are respectively added to 100 ml of highly red-sensitive silver to iodobromide emulsion (7.0 ml % AgI) and resulted dispersions are coated on the bilm supports and dried, and thereby, four samples are obtained.

These obtaind samples are exposed to light by an ordinary manner and processed by the same manner as in Example 3.

The results of photographic test are showed in Table 3, in which RMS is 1000 times value of standard deviation of dendities obtained by scanning the examples by a microdensitometer having 19 type aperture of 2.5μ, and U 0.5 is spatial frezuency when MT factor decreaded to 50%.

Table 3

| Sample | Fog | Relative Sensitivity | γ-Value | Granurality (RMS) | Sharpness (U 0.5) |
|---|---|---|---|---|---|
| A | 0.20 | 100 | 1.00 | 57 | 50 |
| B | 0.10 | 97 | 0.72 | 40 | 40 |
| C | 0.12 | 95 | 0.72 | 43 | 41 |
| D | 0.14 | 90 | 0.71 | 45 | 43 |

As apparent from Table 3, samples B and D exhibit superior gradation, granularity and sharpness than examples A and C.

What is claimed is:

1. A silver halide sensitive photographic material comprising a photosensitive emulsion layer, said layer containing the coupler represented by the formula:

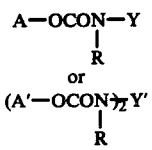

[I]

[II]

wherein A and A' are a naphthol or phenol type cyan coupler monovalent residue in the 4 position, R is hydrogen, an alkyl group, an alkenyl group, a phenyl group, a naphthyl group, a pyridyl group, a quinolyl group, a thienyl group, a piperidyl group or an imidazolyl group all of which groups can have a substituent or substituents which are selected from halogen, nitro, carboxy, amino, a substituted amino group, a sulfo group, an alkyl group, an alkenyl group, a phenyl group, a naphthyl group, an alkoxy group, an aryloxy group, an arylthio group, an arylazo group, an acylamino group, a carbamoyl group, an ester group, an acetyl group, an acyloxy group, a sulfonamido group, a sulfonyl group, a morpholino group, a piperazyl group and an imidiazolyl group; Y is an acetyl group, a benzoyl group, a napthoyl group, an alkyl group, a phenyl group, a naphthyl group, a pyridyl group, a quinolyl group, a thienyl group, a piperidyl group or an imidazolyl group all of which groups can have a substituent or substituents which are selected from halogen, nitro, hydroxyl, carbamoyl, amino, a substituted amino group, a sulfo group, an alkyl group, an alkenyl group, a phenyl group, a naphthyl group, an arylazo group, an acylamino group, an ester group, an acetyl group, an acyloxy group, a sulfon amido group, a sulfonyl group, a morpholino group, a piperazyl group and an imidazolyl group, or $-SO_2-R_2$ in which $R_2$ is an alkyl or alkenyl group which can have a substituent or substituents which are selected from halogen, nitro, hydroxyl, carbamoyl, a sulfo group, amino, a substituted amino group, a phenyl group, a naphthyl group, an alkoxy group, an aryloxy group, an arylthio group, an arylazo group, an acylamino group, an ester group, an acetyl group, an acyloxy group, a sulfonamido group, a sulfonyl group, a morpholino group, a piperazyl group and an imidazolyl group, and Y' is oxygen, sulfur, amino, carboxyl, an aminocarbonyl group, a carbonyl group, a thiocarbonyl group, a sulfonyl group,

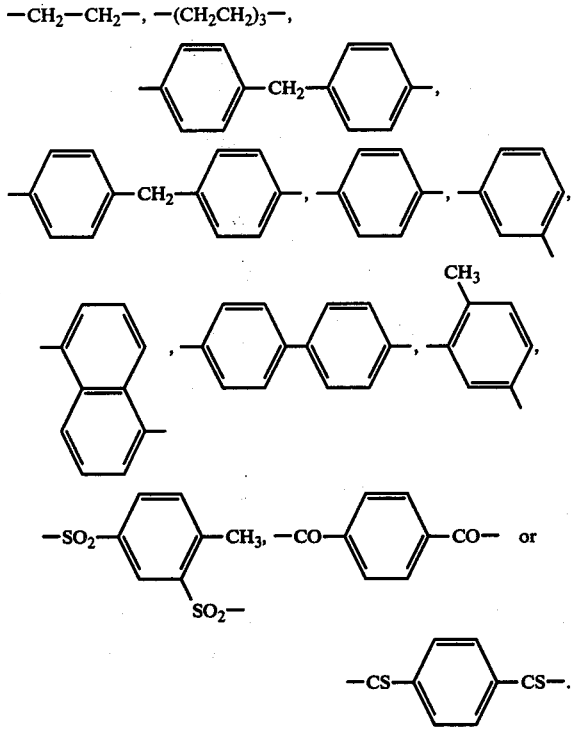

2. A silver halide material according to claim 1 wherein said cyan coupler residue is represented by the following formulas [IV], [V] or [VI]:

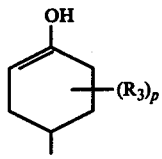

[IV]

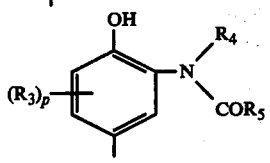

[V]

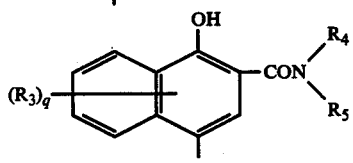

[VI]

wherein $R_3$ is hydrogen, halogen, or an alkyl or alkenyl group which can have a substituent or substituents which are selected from halogen, nitro, hydroxy, carboxyl, amino, a substituted amino group, a sulfo group, phenyl group, a naphthyl group, an alkoxy group, an aryloxy group, an arylthio group, an arylazo group, an acylamino group, a carbamoyl group, an ester group, an acetyl group, an acyloxy group, a sulfonamido group, a sulfamoyl group, a sulfonyl group, a morpholine group, a piperazyl group and an imidazolyl group, or $-O-R_6$ or $-S-R_6$ in which $R_6$ is an alkyl or alkenyl group which can have a substituent or substituents which are selected from halogen, nitro, hydroxyl, carboxyl, amino, a sustituted amino group, a sulfo group, a phenyl group, a naphthyl group, an alkoxy group, an aryloxy group, an arylthio group, an arylazo group, an acylamino group, a carbamoyl group, an ester group, an acetyl group, an acyloxy group, a sulfonamido group, a sulfamoyl group, a sulfonyl group, a morpholino group, a piperazyl group and an imdazolyl group; $R_4$ and $R_5$ are individually an alkyl group, an alkenyl group, a phenyl group, a naphthyl group or a 5- or 6-membered heteroring containing nitrogen, sulfur and/or oxygen atom which groups or rings can have a substituent or substituents which are selected from halogen, nitro, hydroxyl, carboxyl, amino, a substituted amino group, a sulfo group, an alkyl group, an alkenyl group, a phenyl group, a naphthyl group, an alkoxy group, an aryloxy group, an arylthio group, an arylazo group, an acylamino group, a carbamoyl group, an ester group, an acetyl group, an acyloxy group, a sulfonamido group, a sulfamoyl group, a sulfonyl group, a morpholine group, a piperazyl group and an imidazolyl group; P is an integer of 1 to 3; and q is an integer of 1 to 5.

3. A silver halide material according to claim 1 wherein the $$\underset{\underset{R}{|}}{OCON}-Y \text{ or } -\underset{\underset{R}{|}}{OCON}-Y-\underset{\underset{R}{|}}{NCOO}-$$

in the formulas is taken from the class consisting of

Methylaminocarbonyloxy group $-OCONHCH_3$
Ethylaminocarbonyloxy group $-OCONHC_2H_5$
Butylaminocarbonyloxy group $-OCONHC_4H_9$ (iso, tert, sec)
Propylaminocarbonyloxy group $-OCONHC_3H_7$ (iso)
Dodecylaminocarbonyloxy group $-OCONHC_{12}H_{25}$
Octadecylaminocarbonyloxy group $-OCONHC_{18}H_{37}$
2,5-di-tert-aminophenoxymethylaminocarbonyloxy group

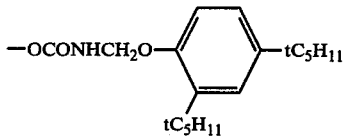

Phenetylaminocarbonyloxy group

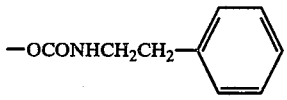

Benzylaminocarbonyloxy group

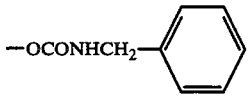

Anilinocarbonyloxy group

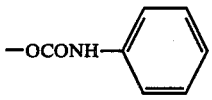

α-Naphthylaminocarbonyloxy group

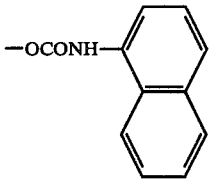

β-Naphthylaminocarbonyloxy group

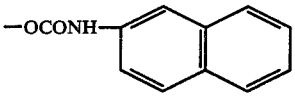

4-Nitroanilinocarbonyloxy group

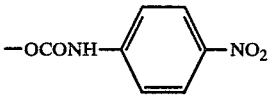

4-Chloroanilinocarbonyloxy group

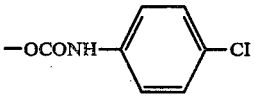

4-Methylanilinocarbonyloxy group

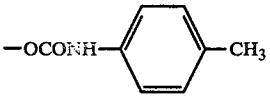

2,4-Dimethylanilinocarbonyloxy group

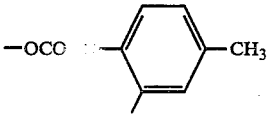

-continued

4-Aminoanilinocarbonyloxy group

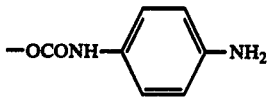

4-(2-Hydroxy-5-sodium-sulfophenylazo)-anilino-carbonyloxy group

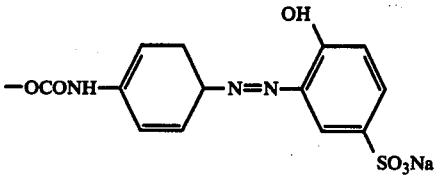

Ethylene-bis-aminocarbonyloxy group —OCONH—$CH_2CH_2$—NHCOO—

Hexamethylene-bis-aminocarbonyloxy group —OCONH—$(CH_2CH_2)_3$—NHCOO—

4,4'-Methylene-bis-anilinocarbonyloxy group

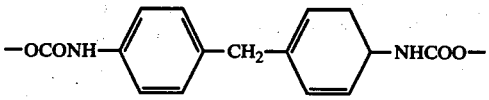

1,4-Phenylene-bis-aminocarbonyloxy group

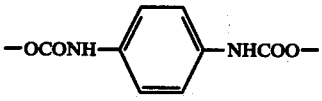

1,3-Phenylene-bis-aminocarbonyloxy group

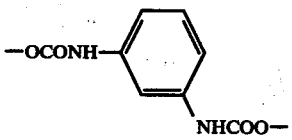

1,5-Naphthalene-bis-aminocarbonyloxy group

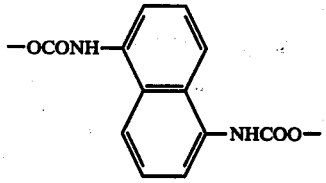

4,4'-Diphenylene-bis-aminocarbonyloxy group

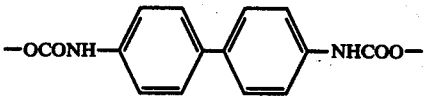

2,4-Tolylene-bis-aminocarbonyloxy group

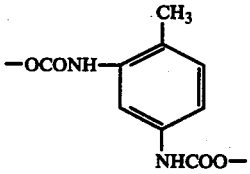

6-Methoxy-4-qunolylaminocarbonyloxy group

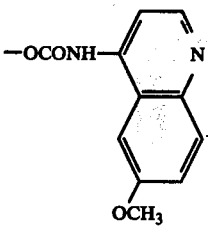

Benzoylaminocarbonyloxy group

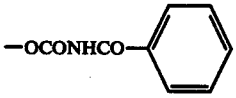

Chloroacetylaminocarbonyloxy group —OCONHCOO$CH_2$CI

N-phenyl-N-acetylaminocarbonyloxy group

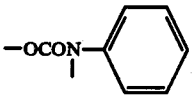

Phenylsulfonylaminocarbonyloxy group

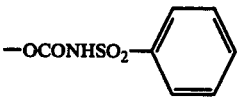

-continued

Thiobenzoylaminocarbonyloxy group

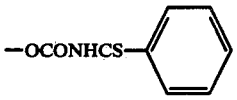

2,4-Tolylene-bis-sulfonylaminocarbonyloxy group

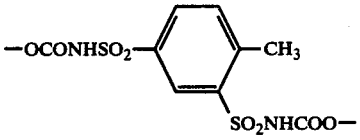

p-Phenylene-bis-carbonylaminocarbonyloxy group

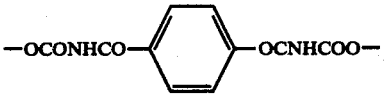

p-Phenylene-bis-thiocarbonylaminocarbonyloxy group

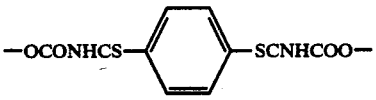

4. A silver halide material according to claim 1 wherein said cyan coupler is taken from the class consisting of (1) I-Hydroxy-4-anilinocarbonyloxy-N-[δ-(2,4-di-tert-amylphenoxy)butyl]-2-naphthoamide

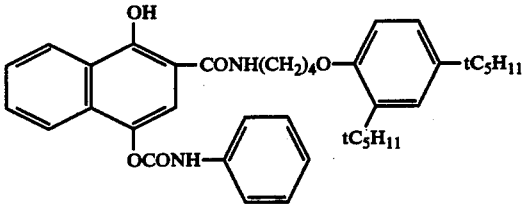

(2) I-Hydroxy-4-(I-naphthylaminocarbonyloxy)-N-[δ-(2,4-di-tert-amylphenoxy)butyl]-2-naphthoamide

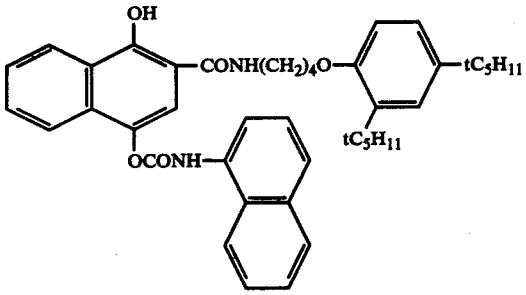

(3) I-Hydroxy-4-(4-nitroanilinocarbonyloxy)-N-[δ-(2,4-di-tert-amylphenoxy)butyl]-2-naphthoamide

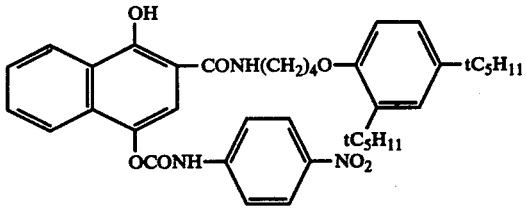

(4) 1,2-Bis-{4-hydroxy-3-[N-[δ-(2,4-di-tert-amylphenoxy)butyl]carbamoyl-1-naphthyloxy-carbamino ethane -continued

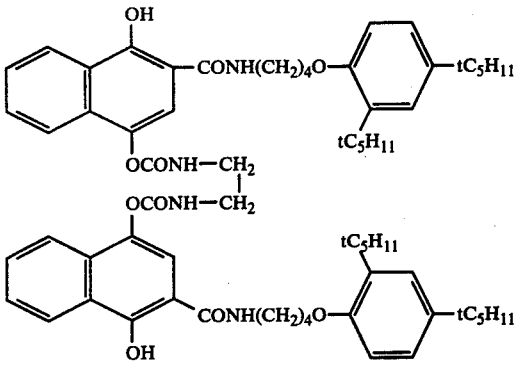

(5) I-Hydroxy-4-(4-chloroanilinocarbonyloxy)-n-dodecyl-2-naphthoamide

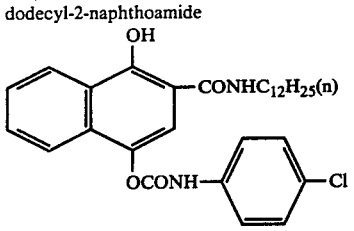

(6) I-Hydroxy-4-[4-(I-hydroxy-3,6-disulfonaphthylazo) anilinocarbonyloxy]-n-dodecyl-2-naphthoamide(2) sodium salt

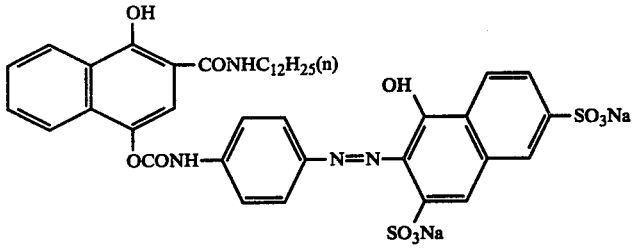

(7) 2,4-Bis-(4-hydroxy-3-n-dodecylcarbamoyl-I-naphthyloxycarbamino)toluene

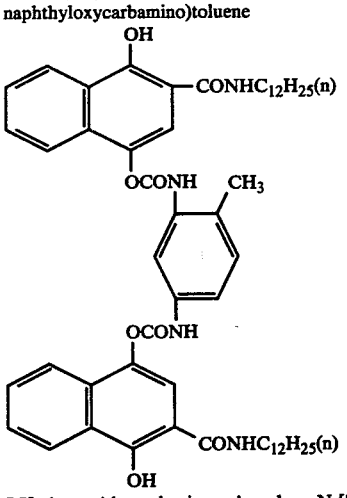

(8) I-Hydroxy-4-benzylaminocarbonyloxy-N-[δ-(3-n-dodecyloxyphenoxy)butyl]-2-naphthoamide

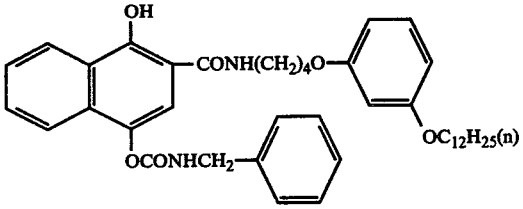

(9) I-Hydroxy-4-[4-(2-hydroxy-3,6-cisulfo-1-naphthylazo) anilinocarbonyloxy]-N-[δ-(3-n-dodecyloxyphenoxy) butyl]-2-naphthoamide (2) sodium salt -continued

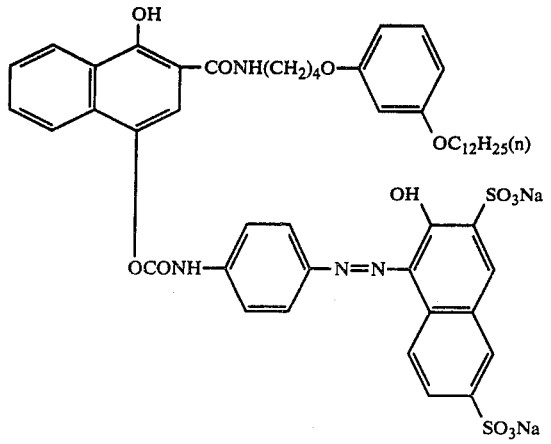

(10) I-Hydroxy-4-ethylaminocarbonyloxy-N-(s-n-tetradecyloxyphemyl)-2-naphtoamide

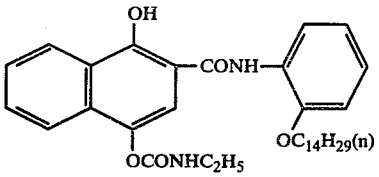

(11) I-Hydroxy-4-ethylaminocarbonyloxy-N-[β-(4-n-lauroylaminophenyl)ethyl]-2-naphthoamide

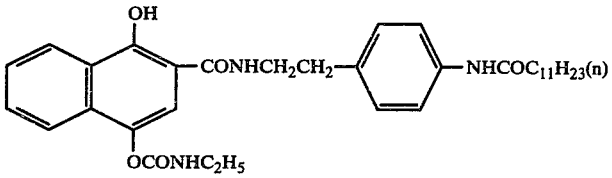

(12) Bis-{4-[4-hydroxy-3-[N-β-(4-lauroylaminophenyl) ethyl]carbamoyl]-1-naphthyloxycarbamino]phenyl} methane

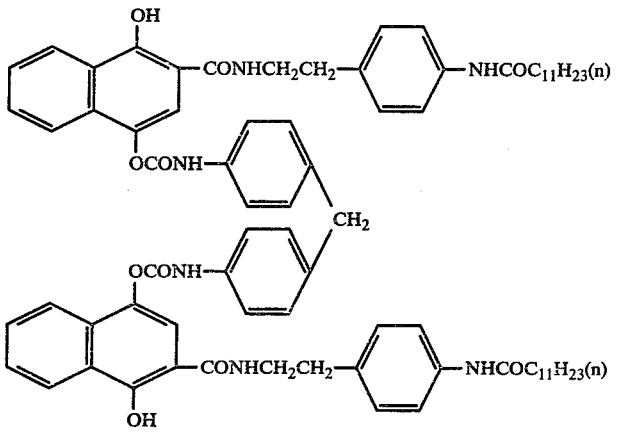

(13) 1-Hydroxy-4-benzoylaminocarbonyloxy-N-[4-(2,4-di-tert-amylphenoxyacetamino)propyl]-2-naphthoamide

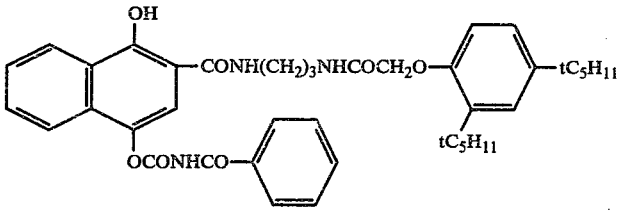

(14) 1-Hydroxy-4-(4-chloroanilinocarbonyloxy)-N-[β-(n-octylthio-α-methylpropionoylamino)-ethyl]-2-naphthoamide -continued

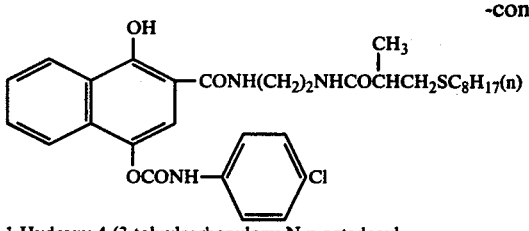

(15) 1-Hydroxy-4-(3-toluylcarbonyloxy-N-n-octadecyl-N-(3,5-dicarboxyphenyl)-2-naphthoamide

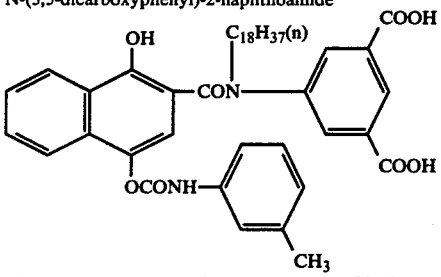

(16) 1-Hydroxy-4-iso-butylaminocarbonyloxy-N-[β-(β-carboxy-β-octadecylpropionoylamino)-ethyl]-2-naphthoamide

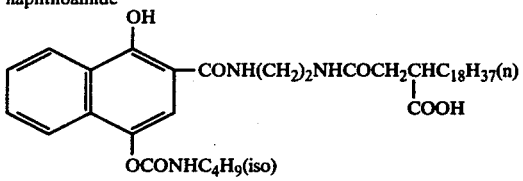

(17) 1-Hydroxy-4-(2,4-di-tert-amylphenoxymethylamino-carbonyloxy)-N-[Y-(2,4-di-tert-amylphenoxy) propyl]-2-naphthoamide

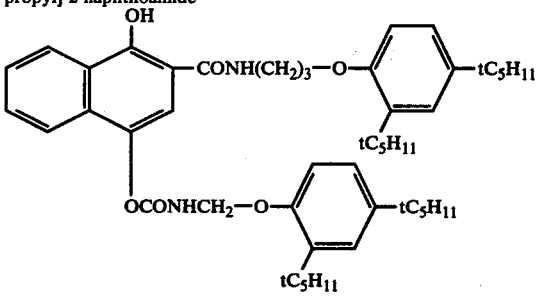

(18) 1-Hydroxy-4-n-dodecylaminocarbonyloxy-N-ethyl-N-sulfoethyl-2-naphthoamide potassium salt

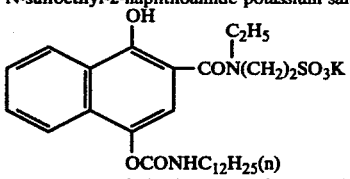

(19) 1-Hydroxy-4-ethylaminocarbonyloxy-N-ethyl-N-(3,5-dicarboxyphenyl)-2-naphthoamide

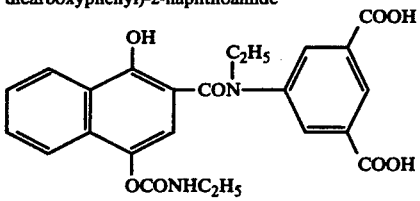

(20) 1-Hydroxy-4-n-dodecylaminocarbonyloxy-N-ethyl-N-(3,5-dicarboxyphenyl)-2-naphthoamide

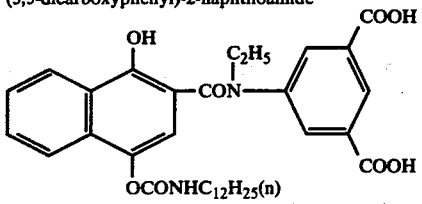

(21) 1-Hydroxy-4-(N-phenyl-N-acetylaminocarbonyloxy)-

-continued naphthoanilide

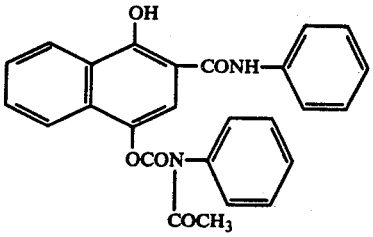

(22) 1-Hydroxy-4-anilinocarbonyloxy-2-naphthomorpholide

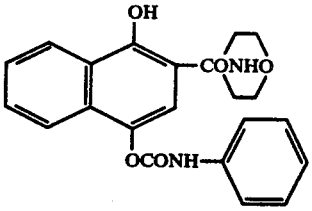

(23) 1-Hydroxy-4-n-octadecylaminocarbonyloxy-2-naphthocyclohexylamide

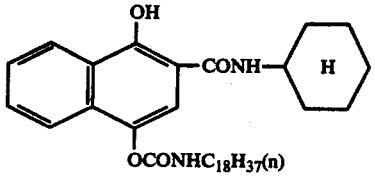

(24) 6-Chloro-5-methyl-4-anilinocarbonyloxy-2-acetoaminophenol

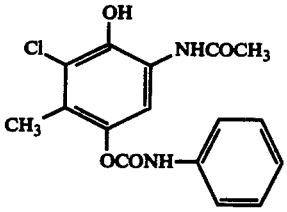

(25) N,N'-ethylene-bis-(4-aminocarbonyloxy-2,5-dichlorophenol)

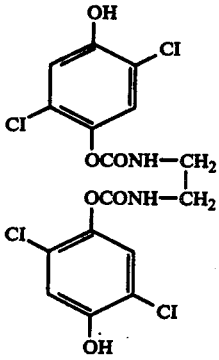

(26) 1-Hydroxy-4-(4-aminoanilinocarbonyloxy)-N-(2-n-tetradecyloxyphenyl)-2-naphthoamide

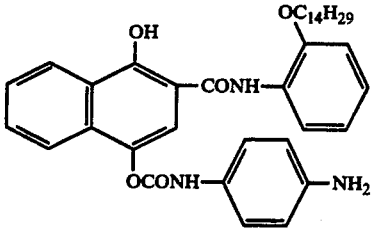

(27) 1-Hydroxy-4-phenylsulfonylaminocarbonyloxy-N-[δ-(2,4-di-tert-amylphenoxy)butyl]-2-naphthoamide -continued
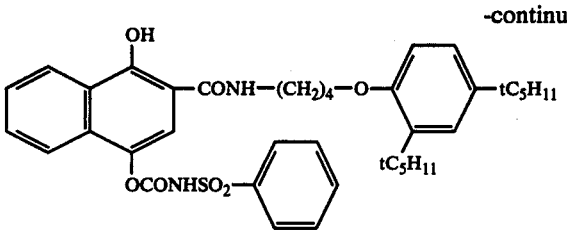
* * * * *